US008727870B2

(12) United States Patent
Simon

(10) Patent No.: US 8,727,870 B2
(45) Date of Patent: May 20, 2014

(54) LOTTERY-LIKE GAME WHERE THE WINNING NUMBER DEPENDS ON THE PLAYERS' CHOICES

(76) Inventor: Burton Simon, Silverthorne, CO (US)

( * ) Notice: Subject to any disclaimer, the term of this patent is extended or adjusted under 35 U.S.C. 154(b) by 0 days.

(21) Appl. No.: 13/559,932

(22) Filed: Jul. 27, 2012

(65) Prior Publication Data

US 2013/0196751 A1 Aug. 1, 2013

Related U.S. Application Data

(60) Provisional application No. 61/513,929, filed on Aug. 1, 2011.

(51) Int. Cl.
*A63F 9/24* (2006.01)

(52) U.S. Cl.
USPC ..... 463/26; 463/42; 463/17; 463/27

(58) Field of Classification Search
USPC ..... 463/26, 42, 27, 17
See application file for complete search history.

(56) References Cited

U.S. PATENT DOCUMENTS

| | | | | |
|---|---|---|---|---|
| 2006/0019736 | A1* | 1/2006 | Amada | 463/17 |
| 2009/0152813 | A1* | 6/2009 | Wolf | 273/269 |
| 2009/0239627 | A1* | 9/2009 | Inamura | 463/20 |
| 2010/0240448 | A1* | 9/2010 | Keenan et al. | 463/27 |
| 2011/0111827 | A1* | 5/2011 | Nicely et al. | 463/20 |
| 2013/0137508 | A1* | 5/2013 | Kelly et al. | 463/27 |

* cited by examiner

*Primary Examiner* — Pierre E Elisca
(74) *Attorney, Agent, or Firm* — Lathrop & Gage LLP

(57) ABSTRACT

A lottery-like game played by a plurality of players, where each player chooses a whole number within some specified range. The winner(s) are determined by a simple rule that depends on the particular choices the players make. The game can be played by a small group in proximity, or by a large group over the internet.

20 Claims, 2 Drawing Sheets

LOTTERY-LIKE GAME WHERE THE WINNING NUMBER DEPENDS ON THE PLAYERS' CHOICES

CROSS-REFERENCE TO RELATED APPLICATIONS

This application claims priority to U.S. Provisional Application 61/513,929, filed Aug. 1, 2011, which is hereby incorporated by reference in its entirety to the extent not inconsistent with the disclosure herewith.

BACKGROUND OF THE INVENTION

The present invention relates to multi-person games, and more particularly to lottery-like games that can be played by a large number of people where prizes can be awarded. The game of the present invention can be played over the internet or in a physical location like a sports bar or casino.

There are many examples of games that are designed to be played by a large number of people. Some of them are well established in American culture, like lotteries and bingo. Lotteries are typically games of chance where players choose (or are assigned) number(s), and the winning number(s) are determined by a random process that is statistically independent of the particular numbers held by the players. Bingo is a game where players choose (or are assigned) a matrix of numbers (a card), and a sequence of numbers are announced. The winner(s) are the player(s) whose cards are first to have a row, column, or diagonal made up of announced numbers. More recently, fantasy sports, and various social games have proliferated on the internet. These games are also designed to be played by large numbers of people connected via a computer network.

In typical lottery games, lottery tickets are offered for sale to a potentially unlimited number of players. Each ticket is assigned an identifier, such as a number. After a set time period is over, a winning number is randomly selected for the lottery game, such as by selecting numbered ping pong balls from a barrel, and tickets matching the selected winning number are winning tickets. Each ticket number may be unique so that there can be only one winning ticket per game, or duplicate ticket numbers may be allowed so that there can be more than one winning ticket per game. The numbers on each ticket may be randomly assigned or the numbers can be selected by the players. If no ticket has the winning number, there will be no winner for that game and any prizes can be carried over to a subsequent game.

A downside to current lottery games is that they do not allow skill or input from the players to affect the outcome of the game. Instead, the outcome of each game is determined completely at random. It would therefore be desirable to have a lottery-like game which involves and rewards skillful play by the players instead of relying entirely luck or chance to determine the outcome.

It would also be desirable to have a lottery-like game which involves a different criterion for choosing winners than for other lottery games and which could be played by a large number of players as well as by a small to medium number of players.

It would also be desirable to have a lottery-like game which could be played at special kiosks in convenience stores and other public places similar to typical lottery games, and which could be played over the internet, through cell phone and small computer applications, or through an interactive website.

SUMMARY OF THE INVENTION

The present invention provides a lottery-like game that can be played by both small numbers and large numbers of people where the actions of the players determine the winner. The present game is similar to traditional lotteries in the sense that a potentially unlimited number of people can play, the players choose specific identifiers (such as numbers), and a winning identifier (number) is then determined. The difference between the present invention and other lottery-like games is that the winning identifier in the present game is determined by the choices made by the players and not by some random process. For example, in one embodiment the winning number can be the number selected by the fewest number of players.

It therefore is an object of the present invention to provide a lottery-like game where the winner is determined by the actions of the players where the game can be adopted by a state, or other large institution, and offered as a game of chance for people to play, for a price, similar to current lotteries and scratch games. Such a game could be played over the internet, and/or by selling physical tickets at convenience stores. Such a game could be run for profit by the institution where winners are chosen according to the rules of the game and which may include progressive jackpots and other embellishments.

It is another object of the present invention to provide a social game that can be played, possibly for no cost, as an application for cell phones and other personal communication devices.

It is another object of the present invention to provide a game that can be played for fun and/or prizes by a relatively small number of people in close proximity, such as at a casino, a party or at a bar or restaurant.

These and other objects and advantages of the invention shall become apparent from the following general and preferred descriptions of the invention.

In one embodiment, the present invention provides a method of playing a game between a plurality of players comprising the steps of: a) providing a first pre-defined selection set to the players wherein the first selection set comprises a first plurality of items that can be selected by the players; b) opening a first selection period wherein during the first selection period the players are able to select a desired item from the first selection set and wherein multiple players are able to select the same item during the first selection period; c) providing one or more user interface stations wherein the players are able to select the items from the set; d) recording each instance each item is selected during the first selection period, thereby generating a total number of instances each item is selected; e) closing the first selection period wherein no further selections can be made for the first selection period; f) determining which items have a greatest total number of instances being selected, a smallest total number of instances being selected, or both, at the closing of the first selection period; and g) determining one or more winning players for the first selection period, wherein winning players are players who selected the item having the greatest total number of instances being selected or the smallest total number of instances being selected at the closing of the first selection period. Preferably, the one or more winning players are players who selected the item having the smallest total number of instances being selected during the selection period (i.e., the least selected number). In case of ties (i.e., where multiple numbers have been selected the least or greatest amount of times), multiple winning numbers can be declared, no winners can be declared, or the winning number can be designated as being the smallest (or alternatively, the largest) of the tied numbers. In one embodiment, the number of players playing the game is not known until the first selection period is closed.

The items able to be selected by the players can be letters, numbers or other kinds of identifying marks, images or symbols. The selection set is a set or group which contains all of the different possible items that can be selected by the players. The selection set is pre-defined in the sense that the players know what items are available to be selected at the time the selection period opens. In one embodiment, the selection set is a set of whole numbers and the desired items are whole numbers within this set. For example, in one embodiment the selection set is the range of whole numbers from 1 to 1,000, from 1 to 10,000, from 1 to 100,000, or from 1 to 1,000,000, and each player is able to select a desired number within this range. Alternatively, the selection set can be any whole number with no limit. However, if the winning number in the selection period is the smallest of the least selected numbers (selected at least once), then players would be at a disadvantage to select high numbers.

By selecting a desired item, a player does not physically remove an item from the selection set. Instead, selecting an item causes that item to be designated as being selected by that particular player. The selected items can be printed on a ticket or the selection recorded on a computer processor or computer readable medium.

Each selection by the players is recorded or kept track of in order to calculate the total number of times each item is selected during the selection period. At the end of the selection period, it is determined which items have been selected the most and/or which items have been selected the least. The winning players are those who have selected the items which have been selected the greatest number of times and/or the least number of times during the selection period. In embodiments where the winning items are those which have been selected the least number of times, items which were not selected are ignored and the winning items are those that have been selected at least once.

In one embodiment where two or more different items have been selected the same number of times and are the items which have been selected the greatest and/or least number of times, the winning item is the highest or lowest ranked item. For example, if the rules of the game are such that the winning number is one that is selected the fewest number of times and two or more numbers are tied for this designation, then the winning number will be the lowest number.

The selection period can be for any length of time, including several days, similar to many typical lotteries, to several minutes, if played at a social setting or sports bar setting. Preferably, the selection period is closed after a pre-determined period of time elapses where the length of the selection period is known to the players at the outset of the game. Alternatively, the selection period is closed after a randomly chosen period of time within a specified range, such as any time between 1 to 2 hours. Particularly where the game of the present invention is provided via a computer network, a new game can be provided immediately after an old game ends. Ending the selection period of a game at a random time may incentivize players to join a current game earlier in order to ensure they join the game before it ends. In another embodiment, the selection period is closed after a pre-determined number of selections have been made.

In a further embodiment, the method comprises awarding a prize to the one or more winning players. Optionally, a bet, token or fee is collected from each player each instance the player selects an item. In a further embodiment, the prize awarded to the winning players is a percentage of the bets, tokens or fees collected from the players. Preferably, the amount of the winnings paid to each winning player is determined by an algorithm maintained on a computer processor. In one embodiment, the bets, tokens or fees are electronic units maintained on a computer processor.

In a further embodiment, the present invention provides one or more additional new games immediately after the initial game ends. For example, the game can optionally consist of multiple rounds where winnings are distributed after each round or awarded for a cumulative score after the final round. The players can be the same from round to round or can change each round, and the selection set can be the same or different from round to round. If there is not a single winning number in any given round, prizes or winnings for that round can be carried over to the next round. This embodiment further comprises: a) providing a second pre-defined selection set to the players wherein the second selection set comprises a second plurality of items that can be selected by the players; b) opening a second selection period wherein during the second selection period the players are able to select a desired item from the second selection set and wherein multiple players are able to select the same item during the second selection period; c) providing one or more user interface stations wherein the players are able to select the items from the second selection set; d) recording each instance each item is selected during the second selection period, thereby generating a total number of instances each item is selected for the second selection period; e) closing the second selection period wherein no further selections can be made for the second selection period; f) determining which items have a greatest total number of instances being selected, a smallest total number of instances being selected, or both, at the closing of the second selection period; and g) determining one or more winning players for the second selection period, wherein winning players are players who selected the item having the greatest total number of instances being selected or the smallest total number of instances being selected for the second selection period. Further embodiments similarly provide a third selection period, fourth selection period, fifth selection period, and so on until the desired number of rounds is completed.

The second (or subsequent) selection set can be the same or different from the first selection set. Preferably, the second (or subsequent) selection set is a set of whole numbers and the desired items are whole numbers within the set, wherein winning players for the second (or subsequent) selection period are players who selected the lowest number having the smallest total number of instances being selected at the during of the second (or subsequent) selection period, wherein items which were not selected at least once during the second (or subsequent) selection period are not used to determine the winning players. Optionally, a bet, a token, or a fee is collected from each player each instance the player selects an item during the second (or subsequent) selection period. The winning players of the second (or subsequent) selection period are paid a percentage of the collected bets, tokens or fees.

The players select the desired items from the selection set from user interface stations. Preferably, any bets, tokens or fees are also collected from the players at the user interface stations. In one embodiment, the user interface stations are physical locations, such as kiosks at convenience stores or retail stores, able to record and print player selections. In another embodiment, user interface stations comprise one or more computer processors connected to a network where the player makes his selection electronically. Optionally, the user interface stations are handheld electronic devices (such as personal digital assistants and smartphones) connected to a network. In one embodiment, the game is provided to the players using a computer network where the selection set and items are electronic units maintained on a computer processor.

In another embodiment, the present invention provides a system for providing a game between a plurality of players, where the system comprises: a) a host processor programmed for analyzing and processing input data, and outputting data and information relevant to the game; and b) one or more user interface stations connected to the host processor, where the one or more user interface stations are able to send player selection input to the host processor.

The host processor is programmed to: 1) provide a first pre-defined selection set to the players wherein the first selection set comprises a first plurality of items that can be selected by the players; 2) open a first selection period wherein during the first selection period the players are able to select a desired item from the first selection set and wherein multiple players are able to select the same item during the first selection period; 3) receive player selection input from the one or more user interface stations; 4) record each instance each item is selected during the first selection period, thereby generating a total number of instances each item is selected; 5) close the first selection period wherein no further selections can be made for the first selection period; 6) determine which items have a greatest total number of instances being selected, a smallest total number of instances being selected, or both, at the closing of the first selection period; and 7) determine one or more winning players for the first selection period, wherein winning players are players who selected the item having the greatest total number of instances being selected or the smallest total number of instances being selected at the closing of the first selection period. Preferably, the first selection set is a set of whole numbers and the desired items are whole numbers within the set. In a further embodiment, the winning players are players who selected the whole number having the smallest total number of instances being selected at the closing of the first selection period. In a further embodiment, if two or more whole numbers are tied for being the least selected number, then the lowest number will be the winning number. In further embodiments, the host processor provides second and subsequent selection sets and selection periods. Optionally, when the first selection period ends, the second selection period begins. In a further embodiment, the second and subsequent selection periods operate the same as the first selection period with the exception that the second and subsequent selection sets may be different from the first selection set.

In a further embodiment, the one or more user interface stations comprise one or more computer processors connected to a network able to transmit player selection input to the host processor. In another embodiment, the user interface stations comprise one or more computer processors, one or more kiosks, one or more handheld electronic devices, or combinations thereof where each user interface station is able to send player selection input to the host processor. In a further embodiment, the host processor is able to notify a user interface station for a specific player whether that player has won.

DETAILED DESCRIPTION OF THE INVENTION

The present invention provides a lottery-like game where the players select numbers (or other identifiers) similar to typical lottery games, but where the winning number is determined by the highest or lowest frequency number being chosen. If there is a tie among two or more numbers, then the lowest (or alternatively, the highest) number wins. Entry fees can be collected similar to typical lottery games, and prizes distributed to the winners.

A particular instance of the game of the present invention is specified by the number of players, n, the range of choices, {1, 2, . . . N}, allowed to the players, and a prize function which determines what the winner(s) win. The rule that determines the winning number is known and communicated to the players in advance. For example, the winning item is the smallest number chosen by at least one player with the property that no other number chosen by at least one player was chosen by fewer players. The prize function can be a fraction of the fees collected from the players, or a fixed amount, or a progressive jackpot, or any of a large number of other possibilities.

It is believed that there are no other lottery-like games in the prior art that determine winners based on the specific choices made by the players in the manner just described. Instead, known lottery games randomly determine the winning numbers. Since the collective choices made by the players in the present invention determine the eventual winner(s), the present game is not a game of pure chance, as other lotteries typically are. Skillful play of the present game is therefore possible, especially when the range of allowable choices, {1, 2, . . . , N}, is large compared to the number of players, n.

Figure 1:
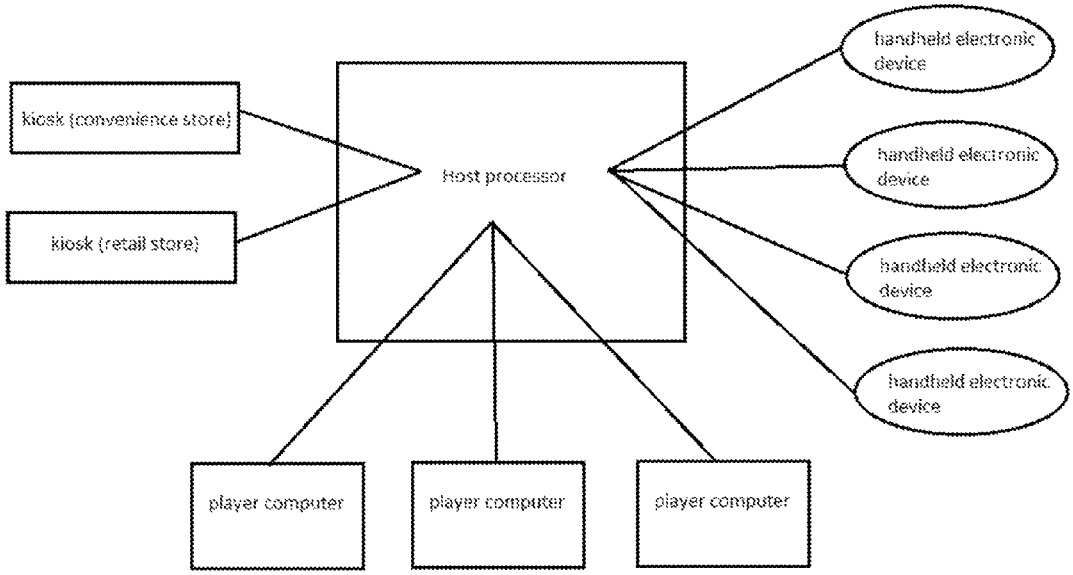
FIG. 1 shows a host processor in one embodiment of the present invention connected in a network to multiple different user interface stations.

Preferably, the games of the present invention are provided using computers or electronic devices connected in a network, such as the internet. As shown in FIG. 1, a host processor is used to administer the game. A plurality of user interface stations is connected to the host processor via a network. Players are able to make selections and pay any entry fees using the interface stations. These selections are communicated to and confirmed by the host processor, which keeps track of each selection. The user interface stations can be any device able to connect to the host processor. For example, multiple different players can make selections using the same authorized kiosk at different times (similar to typical lottery games), or players can log into the game using a personal computer or handheld electronic device (such as a smartphone). For personal computers or handheld devices, a specific application or website may need to be used to access the game. Allowing players to use computers or handheld devices encourages greater participation of the game and enables the game to be operated efficiently at social setting such as sports bars or restaurants.

Figure 2:
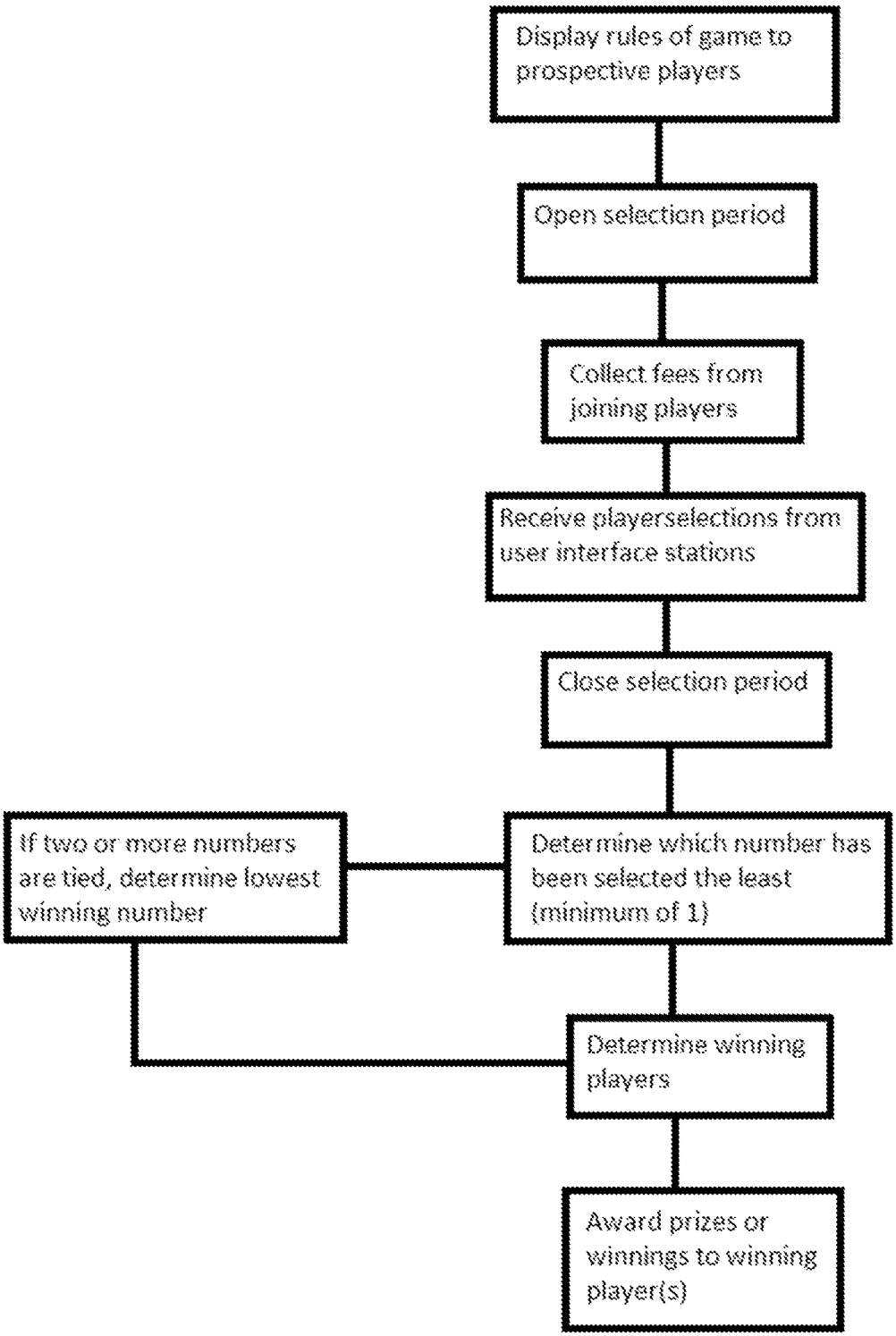
FIG. 2 is a flow diagram showing the steps a host processor from FIG. 1 performs while providing a game of the present invention.

In one typical game, as illustrated in FIG. 2, the host processor displays the rules of the game (such as the amount of the entry fee, the time the game will be operated, what numbers or items can be selected, and how winners are determined) to prospective players. The host processor opens the selection period and receives the selections from the players. The host processor can also collect any entry fees at this time, such as through electronic payment or by accessing a player account. The host processor receives the player selections and closes the selection period after a pre-determined time. The host processor determines the winning number by determining which number or numbers, which have been selected by at least one player, have been selected the least amount of times. If two or more numbers satisfy this provision, the lowest number is determined to be the winning number. The host processor then determines which player or players selected the winning number and awards prizes to the winner(s) accordingly. Prizes can be paid to the winning player(s) electronically or placed in an account until collected by the winning player(s).

Further non-limiting variations of the present invention are explained and described in the examples presented below.

EXAMPLES

Example 1

This example describes one embodiment of the game where 50 players each pay $1 to play. The players are allowed to choose any whole number (1, 2, 3, 4, . . . ) with no upper limit. The players each choose a number, without knowing what the players selected, and when they are done, suppose the result is as follows:

| | Choice | | | | | | | | | | | | | | | | | | |
|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | Etc. |
| frequency | 8 | 9 | 0 | 7 | 5 | 1 | 3 | 10 | 4 | 1 | 0 | 1 | 0 | 0 | 0 | 1 | 0 | 0 | 0 |

In this example, nobody chose a number bigger than 18, so the table stops there. The winning number in this example is 6, since it is the smallest of the numbers chosen by only one player. The player who chose 6 wins the prize; which is the $50 the players paid to play, minus any share or administrative fees by the organization running the game.

Sometimes the winning number is chosen by more than one player. For example, if the same 50 players play again, the result may look like this:

| | Choice | | | | | | | | | | | | | | | | | | |
|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | Etc. |
| frequency | 6 | 7 | 3 | 7 | 5 | 4 | 0 | 6 | 2 | 4 | 0 | 3 | 3 | 0 | 0 | 0 | 0 | 0 | 0 |

The winning number in this round is 9 (the smallest, least popular choice), which was chosen by two players. In this case, those two players split the prize.

If the number of players is small, like in the examples above, players will not want to pick a number bigger than around twenty as big numbers are very unlikely to win even if selected only once. But if a million people play, strategies can become quite different. First of all, the prize will be $1 million (minus any share or administrative fees by the organization running the game). Furthermore, every small number will probably be chosen many times, so the winning number will typically be much larger. Of course, if every player thinks this way, then a clever player can win by choosing number 1 or 2.

This game can be played by any number of players. As the number of players increases, the prize amount increases proportionately, and (of course) it becomes harder to win. Every day, or whenever the game is provided, the player (or players) that choose the smallest least-popular number win a prize. With a million players, every round results in a million dollars in prize money goes to the player(s) that make the right choice.

In order for players to choose their numbers wisely, they may want to know about how many other people will also be playing and the past selection habits of other players as a whole. This kind of information, and other statistics of interest, can be provided if desired. For instance, a website could be used to provide information on winning numbers, number of players, most popular choices, numbers nobody chose, and other useful facts that players can access.

The strategies can also change if the set of possible choices is limited. For instance, if the players are allowed to select a number from 1 to 100, and there are a million players (with an approximate one million dollar prize), there are enough players so that 10,000 players could select each number. The least popular number will likely have less than 10,000 players, but there will still be thousands of winners splitting the prize (for example, an average of more than $100 payout to each winning player).

If 500 players play a game where the selection set is the set of whole numbers between 1 and 20, the result could look something like this:

| | Choice | | | | | | | | | | | | | | | | | | | |
|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 |
| Frequency | 44 | 41 | 36 | 24 | 30 | 16 | 34 | 28 | 24 | 25 | 16 | 32 | 14 | 22 | 23 | 14 | 21 | 18 | 15 | 23 |

In this instance, there are so many players compared to the size of the selection set that every number is chosen multiple times. The least popular choices in this example are numbers 13 and 16, with only 14 players choosing them, so the winning number is 13 (the smallest least popular choice). The prize of $500 (minus any administration fees) is split between the 14 winners.

If one million people play a version where players choose a number between 1 and 500, then there would be an average of about 2,000 winners (i.e. 1,000,000/500=2000), and each winner will get about $500. In general, if the upper limit of the selection set=N, and the number of players is far greater than N players, then the chances an average player wins is about 1/N, and the prize for winners is about $N (minus any administrative fees). So, for a particular game, the game administrator can limit the number of choices (such as N=10) or some other number to adjust the odds and payout.

Example 2

This example describes a game run by a state or regional government similar to many current lotteries and scratch games. Games are run on a daily, weekly or monthly basis, with winners determined at a set time every night, day of the week or day of the month. During the time the selection period is open, players can play at a special website, or using a special cell phone app, or at a special convenience store kiosk. To play the game, players first pay a fee, and then choose a number by typing it in using the player interface. Players choose their number by themselves; numbers are not assigned by the organization operating the game. The player then gets a receipt, which is electronic if the game is played using cell phone or other electronic communication device, and which is printed on paper for players using a public kiosk. The system does not reveal the numbers chosen by the players to anybody until the game is over. When the game is over, the winners are determined and awarded their prizes. The total prize is a fraction (for example, 75%) of the total fees paid by the players, which is split evenly by the winners. The remainder of the fees is profit for the organization operating the game.

Example 3

Another embodiment is an hourly (or daily, or weekly or monthly) running of a game similar to as described in Example 2 except with a progressive jackpot. A player wins the progressive jackpot if that player is the only player to pick the winning number. If there is not a sole winner for that round or selection period, then the jackpot is increased for the next round or selection period. After each round or selection period that the progressive jackpot is not won, the range of choices for the players {1, 2, . . . , N} is increased, thereby decreasing the chance that multiple players select the same winning number. In this way the amount of time until the progressive jackpot is won is not excessive. When the progressive jackpot is won, the cycle resets and begins again.

Example 4

This version provides a game played by a relatively small number of players in proximity, such as at a home party, or at a bar or restaurant. The game is administered by the hosts in the case of a home party, and by the owners/managers in the case of bar or restaurant. Administrators use an internet service to offer the game. The administrator chooses the range of allowable choices for the players, and the web service collects the players' choices, determines the winner, and other bookkeeping duties needed to run the game. The players can use their smart phones or other personal communication device to play. Prizes can be awarded to winners.

Example 5

This version provides a game played by a relatively small number of "friends" over the internet, as a social game, using an infrastructure supplied by e.g., Facebook. The friends decide on a range of numbers to choose from, and the Facebook app collects the players' choices, determines the winner(s), and other bookkeeping duties needed to run the game.

Having now fully described the present invention in some detail by way of illustration and examples for purposes of clarity of understanding, it will be obvious to one of ordinary skill in the art that the same can be performed by modifying or changing the invention within a wide and equivalent range of conditions, elements and other parameters without affecting the scope of the invention or any specific embodiment thereof, and that such modifications or changes are intended to be encompassed within the scope of the appended claims.

When a group of materials, compositions or components is disclosed herein, it is understood that all individual members of those groups and all subgroups thereof are disclosed separately. When a Markush group or other grouping is used herein, all individual members of the group and all combinations and subcombinations possible of the group are intended to be individually included in the disclosure. Every combination of components described or exemplified herein can be used to practice the invention, unless otherwise stated. In the disclosure and the claims, "and/or" means additionally or alternatively. Moreover, any use of a term in the singular also encompasses plural forms.

The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. The invention illustratively described herein suitably may be practiced in the absence of any element or elements, limitation or limitations which is not specifically disclosed herein. All headings used herein are for convenience only.

The invention claimed is:

1. A method of playing a game between a plurality of players comprising the steps of:

a. providing a first pre-defined selection set to the players wherein the first selection set comprises a first plurality of items that can be selected by the players;

b. opening a first selection period wherein during the first selection period the players are able to select a desired item from the first selection set and wherein multiple players are able to select the same item during the first selection period;

c. providing one or more user interface stations wherein the players are able to select the items from the set;

d. recording each instance each item is selected during the first selection period, thereby generating a total number of instances each item is selected;

e. closing the first selection period wherein no further selections can be made for the first selection period; and f. determining, by a computer, which items have a greatest total number of instances being selected, a smallest total number of instances being selected, or both, at the closing of the first selection period; and g. determining one or more winning players for the first selection period, wherein winning players are players who selected the item having the greatest total number of instances being selected or the smallest total number of instances being selected at the closing of the first selection period.

2. The method of claim 1 wherein winning players are players who selected the item having the smallest total number of instances being selected at the closing of the first selection period, wherein items which were not selected at least once during the first selection period are not used to determine the winning players.

3. The method of claim 1 further comprising collecting a bet, a token, or a fee from a player each instance the player selects an item.

4. The method of claim 3 wherein the one or more winners and winnings paid to each winning player are determined by an algorithm on a computer processor.

5. The method of claim 1 further comprising collecting a bet, a token, or a fee from a player each instance the player selects an item and paying each of the one or more winning players a percentage of the collected bets, tokens or fees.

6. The method of claim 1 wherein the selection set and the desired items are electronic units maintained on a computer processor.

7. The method of claim 1 wherein the one or more user interface stations comprise one or more computer processors connected to a network and the selections are made electronically.

8. The method of claim 1 wherein the first selection period is closed after a pre-determined period of time elapses.

9. The method of claim 1 wherein the first selection period is closed after a randomly chosen period of time within a specified range elapses.

10. The method of claim 1 wherein the first selection period is closed after a pre-determined number of selections has been made.

11. The method of claim 1 wherein the first selection set is a set of whole numbers and the desired items are whole numbers within the set.

12. The method of claim 11 wherein winning players are players who selected the whole number having the smallest total number of instances being selected at the closing of the first selection period, wherein numbers which were not selected at least once during the first selection period are not used to determine the winning players.

13. The method of claim 12 wherein if two or more whole numbers have been selected the same number of times and are the numbers having the smallest total number of instances being selected at the closing of the first selection period, then the winning players are players who selected the lowest whole number having the smallest total number of instances being selected.

14. The method of claim 1 further comprising:

a. providing a second pre-defined selection set to the players wherein the second selection set comprises a second plurality of items that can be selected by the players;

b. opening a second selection period wherein during the second selection period the players are able to select a desired item from the second selection set and wherein multiple players are able to select the same item during the second selection period;

c. providing one or more user interface stations wherein the players are able to select the items from the second selection set;

d. recording each instance each item is selected during the second selection period, thereby generating a total number of instances each item is selected for the second selection period;

e. closing the second selection period wherein no further selections can be made for the second selection period; and f. determining which items have a greatest total number of instances being selected, a smallest total number of instances being selected, or both, at the closing of the second selection period; and g. determining one or more winning players for the second selection period, wherein winning players are players who selected the item having the greatest total number of instances being selected or the smallest total number of instances being selected for the second selection period.

15. The method of claim 14 wherein the second selection set is different from the first selection set.

16. The method of claim 14 further comprising collecting a bet, a token, or a fee from a player each instance the player selects an item during the second selection period and paying each of the one or more winning players of the second selection period a percentage of the collected bets, tokens or fees.

17. The method of claim 16 wherein the second selection set is a set of whole numbers and the desired items are whole numbers within the set, wherein winning players for the second selection period are players who selected the lowest number having the smallest total number of instances being selected at the during of the second selection period, wherein items which were not selected at least once during the second selection period are not used to determine the winning players.

18. A system for providing a game between a plurality of players, where said system comprises:

a. a host processor programmed for analyzing and processing input data, and outputting data and information relevant to the game; and b. one or more user interface stations connected to said host processor, said one or more user interface stations able to send player selection input to said host processor;

wherein said host processor is programmed to:

1. provide a first pre-defined selection set to the players wherein the first selection set comprises a first plurality of items that can be selected by the players;

2. open a first selection period wherein during the first selection period the players are able to select a desired item from the first selection set and wherein multiple players are able to select the same item during the first selection period;

3. receive player selection input from the one or more user interface stations;

4. record each instance each item is selected during the first selection period, thereby generating a total number of instances each item is selected;

5. close the first selection period wherein no further selections can be made for the first selection period; and 6. determine which items have a greatest total number of instances being selected, a smallest total number of instances being selected, or both, at the closing of the first selection period; and 7. determine one or more winning players for the first selection period, wherein winning players are players who selected the item having the greatest total number of instances being selected or the smallest total number of instances being selected at the closing of the first selection period.

19. The system of claim 18 wherein the one or more user interface stations comprise one or more computer processors connected to a network able to transmit player selection input to the host processor.

20. The method of claim 18 wherein the first selection set is a set of whole numbers and the desired items are whole numbers within the set, wherein winning players are players who selected the whole number having the smallest total number of instances being selected at the closing of the first selection period, and wherein if two or more whole numbers have been selected the same number of times and are the numbers having the smallest total number of instances being selected at the closing of the first selection period, then the winning players are players who selected the lowest whole number having the smallest total number of instances being selected.

* * * * *